United States Patent [19]

Takano et al.

[11] Patent Number: 4,922,295

[45] Date of Patent: May 1, 1990

[54] COPYING APPARATUS HAVING A DISPLAY WARNING

[75] Inventors: Yoshiaki Takano; Tsuneo Kitagawa, both of Osaka, Japan

[73] Assignee: Minolta Camera Kabushiki Kaisha, Osaka, Japan

[21] Appl. No.: 209,897

[22] Filed: Jun. 22, 1988

[30] Foreign Application Priority Data

Jun. 25, 1987 [JP] Japan ..... 62-158581

[51] Int. Cl.[5] ..... G03G 15/00

[52] U.S. Cl. ..... 355/209; 355/206

[58] Field of Search ..... 355/14 R, 14 C, 3 R

[56] References Cited

FOREIGN PATENT DOCUMENTS 59-181363 of 1984 Japan .
62-164211 of 1987 Japan .

*Primary Examiner*—R. L. Moses
*Attorney, Agent, or Firm*—Burns, Doane, Swecker & Mathis

[57] ABSTRACT

A copying apparatus reduces the possibility of copying error by displaying the copying parameters in different modes. The copying parameters include, for example, the number of copies, the paper size, and the magnification. Since the copying parameters may vary from one copying job to the next, the copying apparatus includes a standard set of copying parameters which are preferably displayed by using continuous lights. After the completion of a copying job, the copying parameters are displayed using intermittent lights, if the copying parameters are different from the set of standard parameters. The intermittent lights provide the next operator of the copying apparatus with an indication that the copying parameters are different from the set of standard parameters.

12 Claims, 12 Drawing Sheets

COPYING APPARATUS HAVING A DISPLAY WARNING

BACKGROUND OF THE INVENTION

1. Field of the Invention

This invention relates to a copying apparatus, and specifically relates to a copying apparatus wherein in executing copying operation by selectively setting arbitrary modes, that is, with conditions such as copy number, copy paper size and copy magnification taken as parameters, display corresponding to selected or set input is performed.

2. Description of the Prior Art

For this kind of copying apparatus, conventionally the copying apparatus has been used which is put in the ready state in the copying modes specified in advance, for example, copy number of 1 and paper size of A4 when copying operation and key operation ended and a predetermined duration has elapsed.

This means that in the case where copying operation and key operation ended and a predetermined duration has elapsed, the copying apparatus is put in the ready state in a predetermined initial state assuming that the use of the copying apparatus has ended for the present. This initial ready-to-operate state can be set in specific modes depending on the user's convenience.

The reason why the copying apparatus is thus put in the ready state in the initial state after a predetermined duration has elapsed from the end of copying operation and key operation is that the number of check items and set items before use can be reduced by putting the copying apparatus in the ready state in predetermined copy modes. Another reason is that in the case where another person performs copying in place of a previous person, if both are not aware of that change, an occurrence of wrong copying by performing copying in the copying modes set by the previous person can be prevented. In order to reduce the number of wrong copies, normally the copying modes in the initial ready-to-operate state are set so that the copy number is small, for example, one sheet.

However, in this type of copying apparatus, copying modes set in performing the previous copying are maintained during the period started from the end of copying to change-over to the copying mode of the initial state because of consideration for continuous use with the same copying modes. When another person performs copying in place of a previous person within the aforementioned period, a problem exists because there is a high possibility of occurrence of wrong copying by performing copying in the copying modes set by the person having performing copying immediately before.

Also, in the copying apparatus not having the so-called auto-clear function mentioned above, the copying modes set before are set successively except in the case where the power switch is turned on or in the case where a manual-clear operation has been performed, and therefore there is a high possibility of wrong copying.

SUMMARY OF THE INVENTION

The present invention has been achieved in the light of such circumstances, and its primary object is to provide a copying apparatus capable of reducing the possibility of wrong copying by another user after copying operation has ended.

A copying apparatus in accordance with the present invention comprises a copying means for copying an image of an original on a copy paper, a parameter setting means for setting conditions relating to copying operation performed by the copying means, a displaying means for displaying the setting state of the parameter setting means, a copy end detecting means for detecting the end of copying operation performed by the copying means, a storing means for storing the standard setting state of the parameter setting means, and a controlling means which makes the displaying means display the setting state of the parameter setting means in a first display form (for example, continuous lighting), and in the case where the setting state of the parameter setting means differs from the stored state in the storing means when the end of copying operation is detected by the copy end detecting means, makes the displaying means display the setting state at that point in a second display form (for example, intermittent lighting) different from the first display form.

In the copying apparatus in accordance with the present invention, by adopting such a configuration, in the case where the copying modes set at the point when copying operation ends for the present differ from the standard state, the displaying means normally performing continuous lighting is controlled to perform intermittent lighting or the like, and therefore the user can easily recognize the state.

The above and further objects and features of the invention will more fully be apparent from the following detailed description with accompanying drawings.

DESCRIPTION OF THE PREFERRED EMBODIMENTS

Figure 1:
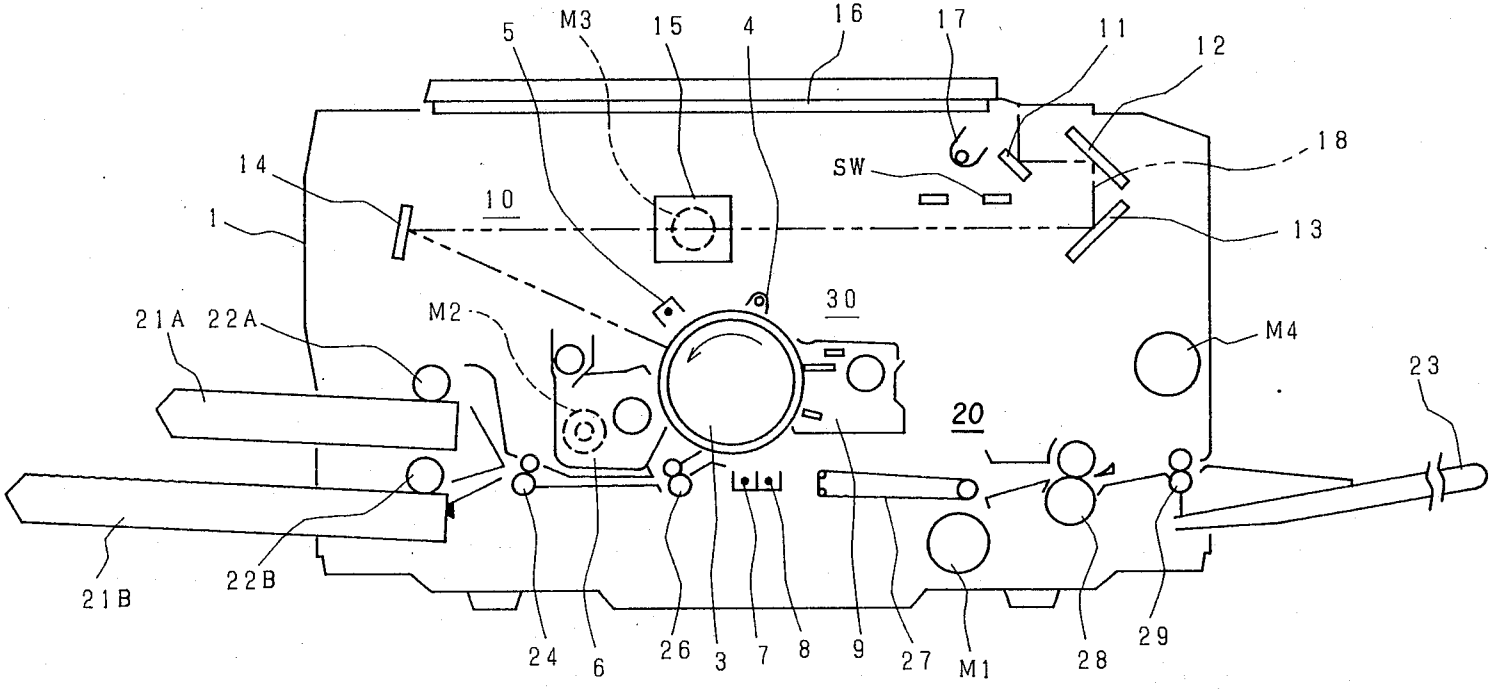
FIG. 1 is a schematic side cross-sectional view showing one example of configuration of a copying apparatus in accordance with the present invention.

FIG. 1 is a schematic configuration view showing a configuration of a copying apparatus of one embodiment in accordance with the present invention. In addition, the general mechanical configuration and copying operation of the copying apparatus are publicly known, and have no direct relation to the gist of the present invention, and therefore only brief description is made thereon.

In the figure, a photo-sensitive drum 3 rotatable counter clockwise is disposed in the center part of a copying apparatus main unit 1, and a main eraser lamp 4, a charger 5, a developing unit 6, a transferring charger 7, a separating charger 8, a cleaner 9 and the like are disposed in sequence around this photo-sensitive drum 3. The abovementioned photo-sensitive drum 3 is provided with a photosensitive, for example, selenium or the like on the surface thereof, receives light irradiation from the main eraser lamp 4 on every copy one copy basis, is charged by passing of the charger 5, and subsequently undergoes an exposure of an image from an optical system 10 as described below.

The optical system 10 is installed under an original glass plate 16 so as to be able to scan an original image.

The above-mentioned optical system 10 is configurated with a light source 17, a first mirror 11, a second mirror 12, a third mirror 13, a fourth mirror 14, a projection lens 15 and the like. In addition, a regular position switch SW is for detecting whether or not the optical system 10 is located at a predetermined position when performing scanning.

In addition, the projection lens 15 is moved in the direction of the optical axis to set an arbitrary magnification, being moved by a motor M3 to the position corresponding to the magnification. After completion of the movement of the lens, for example, where the (copy) magnification is N, the light source 17 and the first mirror 11 are moved left by a scanning motor M4 at a speed of V/N to a constant peripheral speed V of the photo-sensitive drum 3 irrespective of equi-magnification or varied magnification, and simultaneously, the second mirror 12 and the third mirror 13 are moved left at a speed of V/2N. Attending on these movements, the original image is exposured in a slit shape on the surface of the photo-sensitive drum 3.

On the left side of the copying apparatus main unit 1, an upper-tier automatic paper feed cassette 21A and a lower-tier automatic paper feed cassette 21B are loaded, respectively. The sizes of paper in the automatic paper feed cassette 21A and the automatic paper feed cassette 21B are detected by paper kind detecting switches (not illustrated).

Paper in the automatic paper feed cassette 21A or the automatic paper feed cassette 21B is selectively fed into the copying apparatus main unit 1 by a upper-tier paper feed roller 22A or a lower-tier paper feed roller 22B in synchronism with the start of image forming, passes through a pair of conveying rollers 24, and is conveyed to a pair of timing rollers 26, and is put in the ready state here.

The paper fed by the timing rollers 26 is brought in close contact with the photo-sensitive drum 3 at the position of the transferring charger 7, and thereon a toner image is transferred by the transferring charger 7, and the paper is separated from the peripheral surface of the photosensitive drum 3 by the separating charger 8. Subsequently, the paper is conveyed by a conveying belt, and pressure fusing of the toner image is performed by passing through a fixing unit 28. Then the paper passes through a pair of discharging rollers 29, being discharged to a tray 23, on a sorter (not illustrated) or the like outside the copying apparatus main unit 1.

The above-mentioned automatic paper feed cassette 21A or automatic paper feed cassette 21B, paper feed roller 22A or paper feed roller 22B, pair of conveying rollers 24, pair of timing rollers 26, transfer belt 27, fixing unit 28 and pair of discharging rollers 29 configurate a paper feeding-discharging system 20.

In addition, after the operation of transferring, the photosensitive drum 3 is removed of remaining toner by the cleaner 9, and is erased of remaining charge by the main eraser lamp 4 and then enters the next copying process.

The copying apparatus performing the operation as mentioned above repeats the copying operation as described above corresponding to the copy number set by the operator before copying operation, and then stops after the lapse of a predetermined duration.

Figure 2:
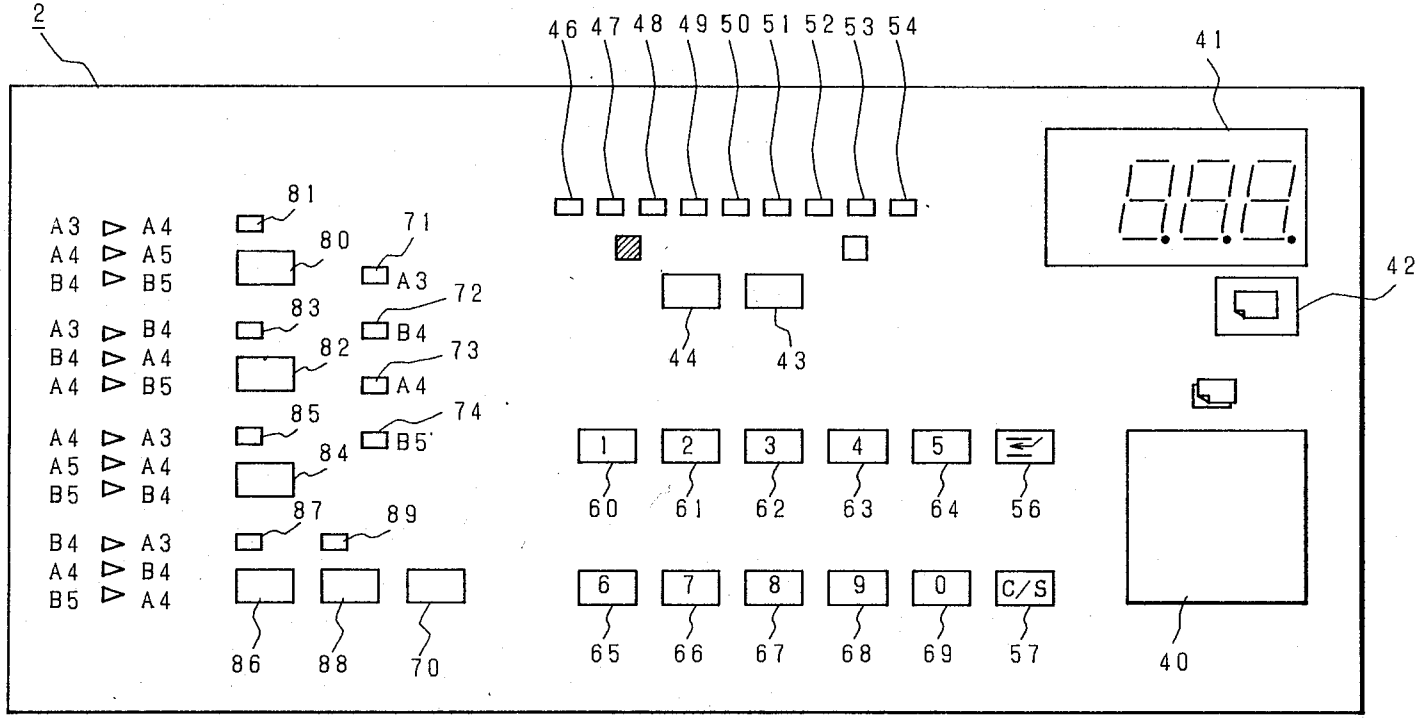
FIG. 2 is a schematic view showing a configuration of an operation panel thereof.

FIG. 2 is a magnified plan view of an operation panel 2 on the top surface of the copying apparatus main unit 1 shown in FIG. 1.

A print start key 40 is for starting copying, ten-keys 60–69 are for setting the copy number and the magnification, an interrupt key 56 is for performing interrupt copying of another copy number during the copying operation of a predetermined copy number. A clear stop key 57 is for clearing data displayed on a numeral display part 41, that is, data inputted by operation of the ten-keys 60–69 and the like. A paper empty indicator 42 is for lighting when no paper exists in a predetermined tray.

In addition, an up key 43 and a down key 44 are exposure keys which change and specify the image density stepwise, and for this purpose they have exposure level indicators in a LED row 46–54 for displaying the image density.

A paper select key 70 is for selecting the paper size to be used, and lights an A3 select indicator 71, a B4 select indicator 72, an A4 select indicator 73 and a B5 select indicator 74 in a circulatory manner every time of operation thereof.

In addition, a A3→A4 reducing magnification select key 80 is for selecting the magnification for performing reduced copying from an A3 original onto A4 paper, from an A4 original onto A5 paper, or from a B4 original onto B5 paper, respectively, and the selected setting state is displayed by an LED indicator 81. Similarly, an A3→B4 reducing magnification select key 82, an A4→A3 enlarging magnification select key 84, and a B4→A3 enlarging magnification select key 86 are for selecting the corresponding magnification, respectively and are provided respectively with LED indicators 83, 85 and 87.

An equi-magnification select key 88 is for copying the original image on paper with equi-magnification, and the selected setting state is displayed by an LED indicator 89.

This means that the respective keys 40, 60–69, 43, 44 and the like are parameter setting means for setting copying conditions assigned to the respective keys as parameters, and the respective indicators 46–54, 81 and the like are displaying means for displaying the setting state of the parameters set by the operation of the corresponding keys. The display means may include numeral displays which display numeric values corresponding to a plurality of states of each condition set by the parameter setting means. A first display form may be a continuous lighting of the numeral displays, and a second display form may be an intermittent lighting of the numeral displays.

Figure 3:
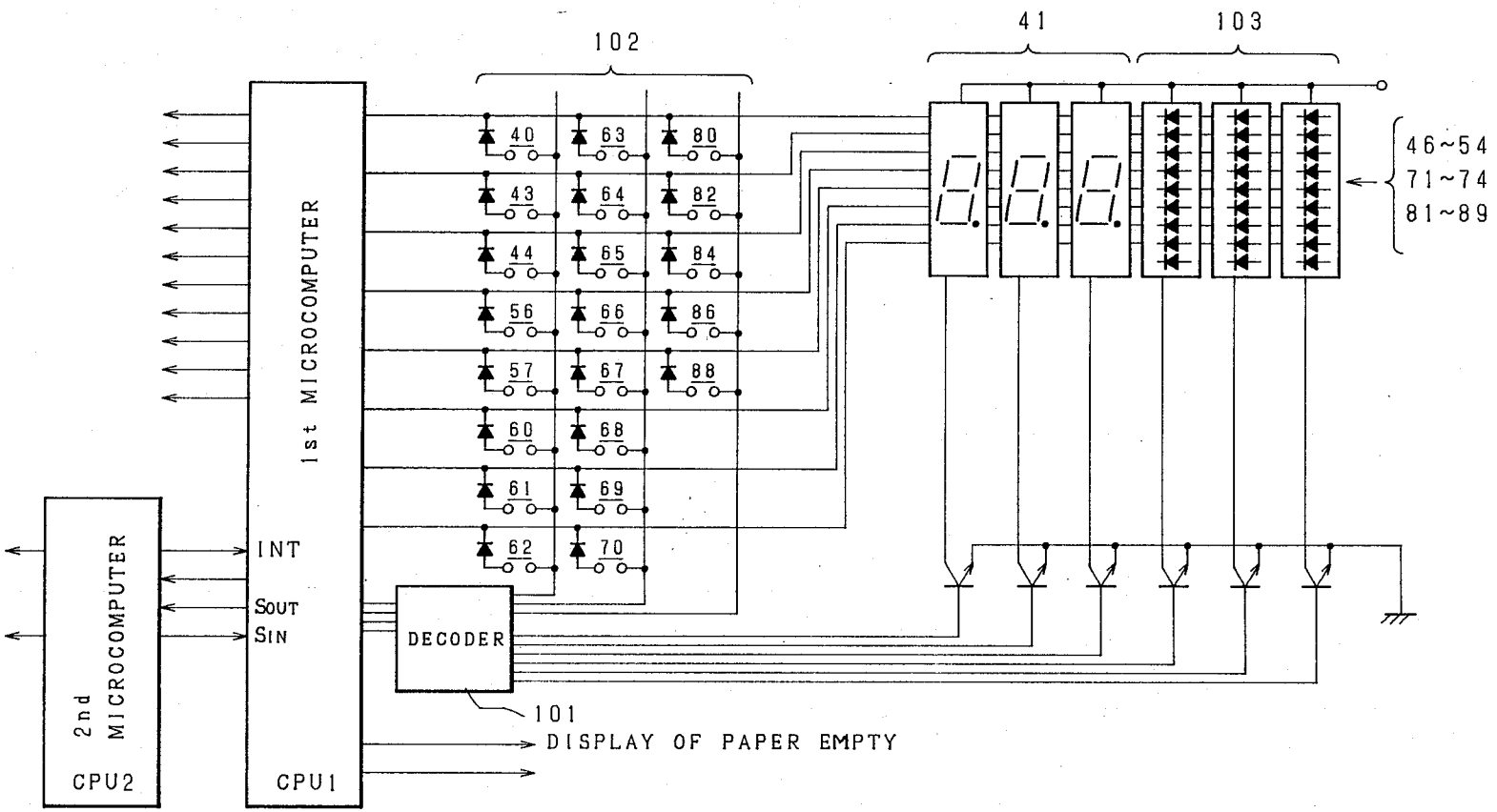
FIG. 3 is a circuit diagram showing a configuration of a controlling circuit thereof.

Next, FIG. 3 is a circuit diagram showing a configuration of a controlling circuit used for a copying apparatus of one embodiment in accordance with the present invention.

In the figure, a first microcomputer CPU 1 operating as a host computer is connected to a second microcomputer CPU 2 through an interrupt terminal and data input-output terminals. The first microcomputer CPU 1 is connected to a key input matrix circuit 102 controlled through a decoder 101 and an LED display group displaying various set modes.

Also, the output of the first microcomputer CPU 1 is connected to the main motor M1, the developing motor M2, the clutch of the timing roller 26, the clutch of the upper-tier paper feed roller 22A, the clutch of the lower-tier paper feed roller 22B, the main eraser 4, the charger 5, the transferring charger 7 and the separating charger 8 through drivers (not illustrated). Also, the CPU 1 receives outputs of various sensors (not illustrated) required for controlling the image forming system 30 and the paper feeding-discharging system 20. Then, the second microcomputer CPU 2 is connected to the magnification setting motor M3 and the scanning motor M4 through drivers (not illustrated). Also, it receives outputs of various sensors (not illustrated) required for scanning.

As mentioned above, the first microcomputer CPU 1 performs control of the image forming system 30 and the paper feeding-discharging system 20, and display and key operation of the above-mentioned operation panel 2. Also, the second microcomputer CPU 2 is used for controlling the scanning motor M4 and the magnification setting motor M3 of the optical system 10.

Figure 4:
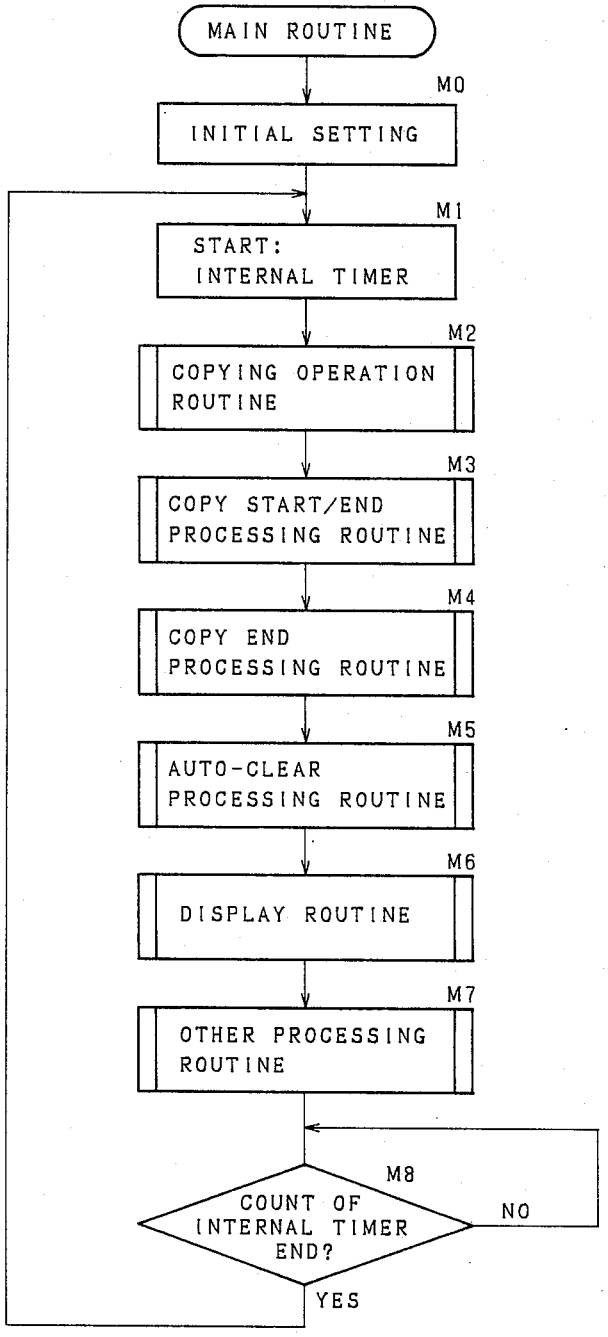
FIG. 4 through FIG. 12 are flowcharts showing controlling procedures thereof.

FIG. 4 is a flow chart of a main routine for controlling the first microcomputer CPU 1 which is a host computer of the copying apparatus of one embodiment in accordance with the present invention.

First, in step M0, initialization is performed by turning on the power switch. In step M1, an inner timer controlling the duration required for one routine of the main routine is started. Thereafter "a copying operation routine" as described later is called in step M2, "a copy start/end processing routine" is called in step M3, "a copy end processing routine" is called in step M4, "an auto-clear processing routine" is called in step M5, "a display routine" is called in step M6, and "other processing routines" whereupon description is omitted here is called in step M7, and in step M8 one routine is completed after time-up of the inner timer.

In addition, the length of duration of this one routine is used for performing counting of various timers used in the above-mentioned various routines. This means that time-up of those various timers can be judged by the duration of execution of this routine.

Also, data communication transmitted from the first microcomputer CPU 1 being the host computer to the second microcomputer CPU 2 is performed independently from this main routine by an interrupt request from the first microcomputer CPU 1 at the processing of each routine.

Figure 5:
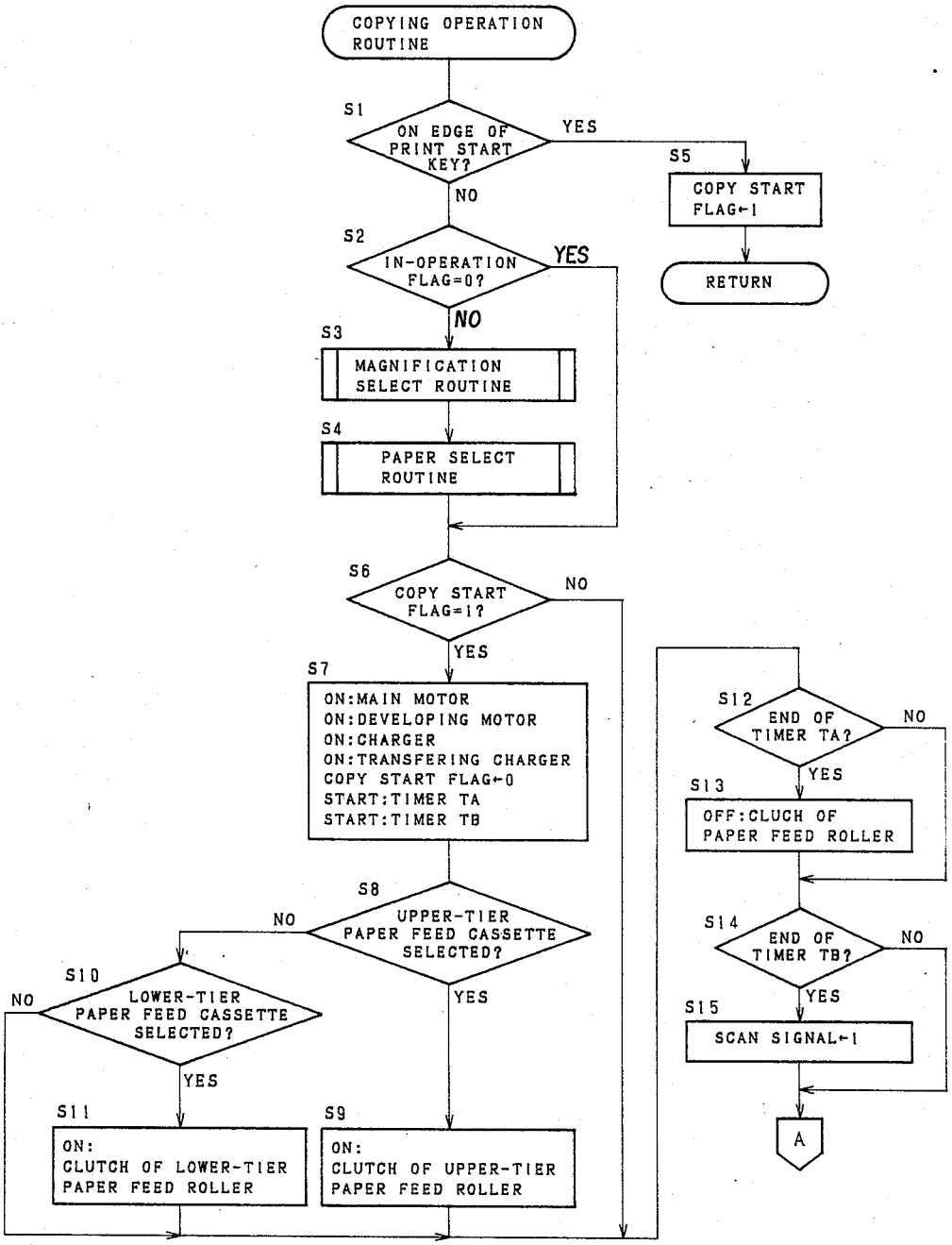
Figure 6:
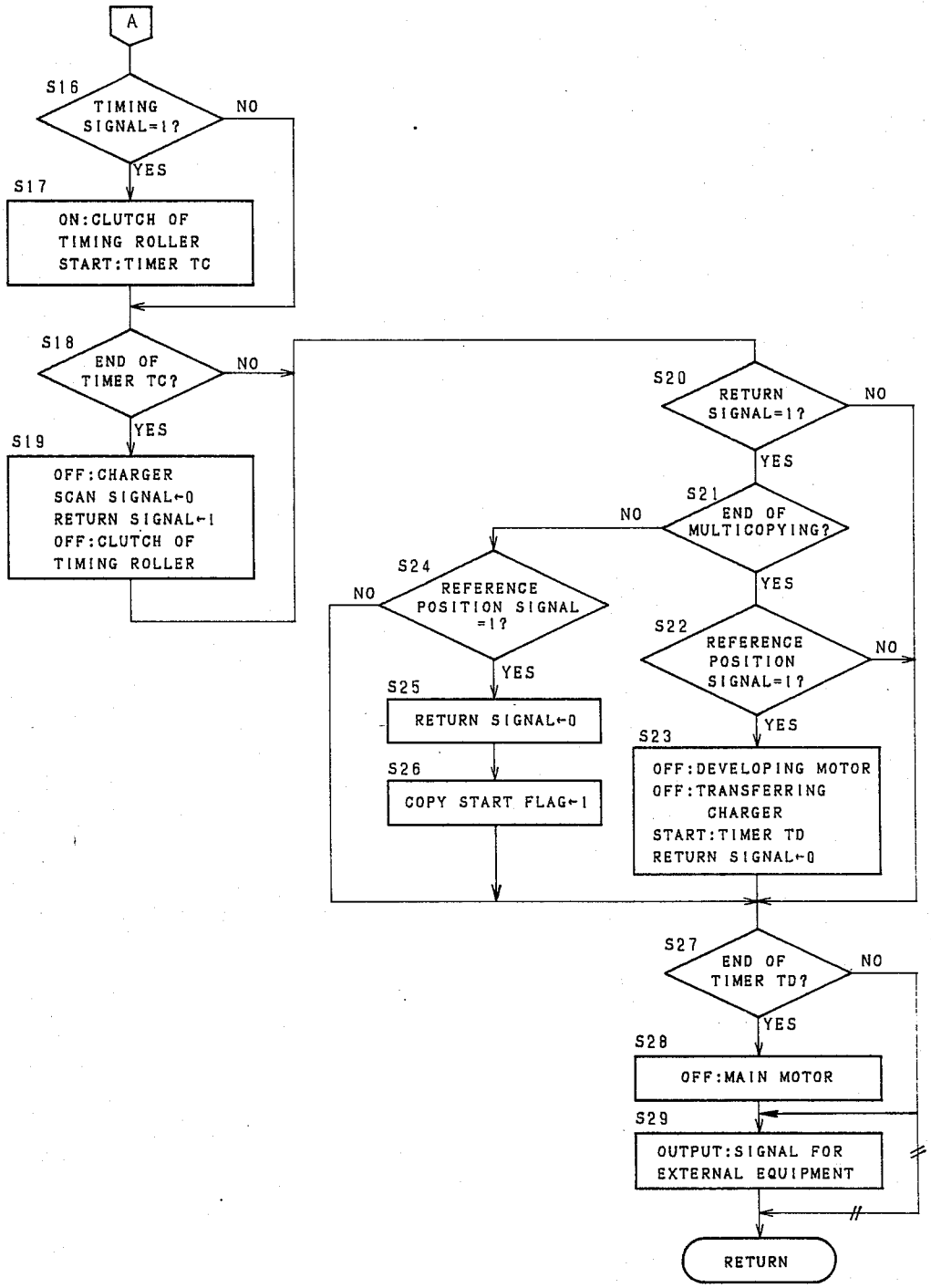

FIG. 5 and FIG. 6 are flowcharts showing details of the above-described "copying operation routine" in step M2.

In this routine, various image forming elements are controlled to perform copying on predetermined paper in response to an operation of the print start key 40.

First, in step S1, on-edge of the print start key 40 is judged. In addition, on-edge of a key refers to a change in the state of the key from the OFF state to the ON state. Here, in the case where an on-edge signal of the print start key 40 is just obtained, in step S5, a copy start flag is set (turned to "1"), and processing returns to the main routine. On the other hand, in the case where the key is not on-edge in step S1, processing proceeds to the next step S2, and judgement is made on whether or not an in-operation flag showing that copying is in operation has been set. As a result, when the copying is not in operation, a predetermined magnification is selected by processing "the magnification select routine" in step S3, and a predetermined paper size is selected by processing "the paper select routine" in step S4.

After step S4, the state of the copy start flag is judged in step S6. As a result, when the copy start flag has been set, in step S7, the main motor M1, the developing motor M4 of the developing unit 6, the charger 5 and the transferring charger 7 are put in the ON state, the copy start flag is removed, and further a timer TA and a timer TB are started, and the copying apparatus is put in the operating state. In addition, the timer TA sets the times of turn-off of the clutches of the paper feed roller 22A of the automatic paper feed cassette 21A and the paper feed roller 22B of the automatic paper feed cassette 21B, and the timer TB sets the commencement of scanning.

In step S8, judgement is made on whether or not the upper-tier automatic paper feed cassette 21A has been selected, and when the automatic paper feed cassette 21A has been selected, the clutch of the upper-tier paper feed roller 22A is turned on in step S9. Also, in step S10, judgement is made on whether or not the lower-tier automatic paper feed cassette 21B has been selected, and when the lower-tier automatic paper feed cassette 21B has been selected, the clutch of the lower-tier paper feed roller 22B is turned on in step S11. Then, in step S12, time-up of the timer TA is judged, and when the time set in the timer TA has expired, the clutch of the paper feed roller 22A or of the paper feed roller 22B is turned off in step S13. Also, in step S14, time-up of the timer TB is judged, and when the time set in the timer TB has expired, a scan signal outputted to the second microcomputer CPU 2 is turned to "1" in step S15.

In addition, the second microcomputer CPU 2 receives the above-mentioned signal, causing exposure scanning to start. The control of this exposure scanning by the second microcomputer CPU 2 has no direct relation to the gist of the present invention, and therefore description thereon is omitted.

In step S16, when the optical system 10 reaches a predetermined position, a timing signal outputted from the second microcomputer CPU 2 is judged. When it is detected that the above-mentioned timing signal is "1", the clutch of the timing roller 26 is turned on in step S17, and paper is fed between the photo-sensitive drum 3 and the transferring charger 7, and transferring of the paper is started. Also, a timer TC is started. In addition, the above-mentioned timer TC is for setting the time of ending scanning, the time of ending charging and the time of turning off the clutch of the timing roller 26, and the set times thereof are determined by the paper size selected in step S8–step S11 and the set (copy) magnification.

In step S18, time-up of the timer TC is judged, and when the time set in the timer TC has expired, in step S19, the charger 5 is turned off, the scan signal is turned to "0", a return signal is turned to "1", and the clutch of the timing roller 26 is turned off.

When the return signal is "1" in step S20, judgement is made on whether or not multicopying has ended in step S21. When the multicopying has ended, in step S22, it is judged that the optical system 10 has returned to the reference position. A reference position signal outputted from the second microcomputer CPU 2 is "1", and in step S23, the developing motor of the developing unit 6 and the transferring charger 7 are turned off, and the return signal is turned to "0", and further a timer TD is started.

On the other hand, the multicopying has not ended in step S21. It is judged that the optical system 10 has returned to the reference position and the reference position signal is "1" in step S24, and the return signal is turned to "0" in step S25, and further the copy start flag is set again (turned to "1") in step S26. Then, time-up of the timer TD is waited in step S27, and subsequently the main motor M1 is turned off in step S28, and each control signal of the external equipment is outputted in step S29. In addition, when the reference position signal is not "1" in step S24, processings in steps S25 and S26 are not performed, and processing proceeds to S27, and waits until the reference position signal goes to "1" next.

The copying operation is performed as described above.

The above-mentioned "magnification select routine" in step S2 and "paper select routine" in step S3 are performed as follows.

Figure 7:
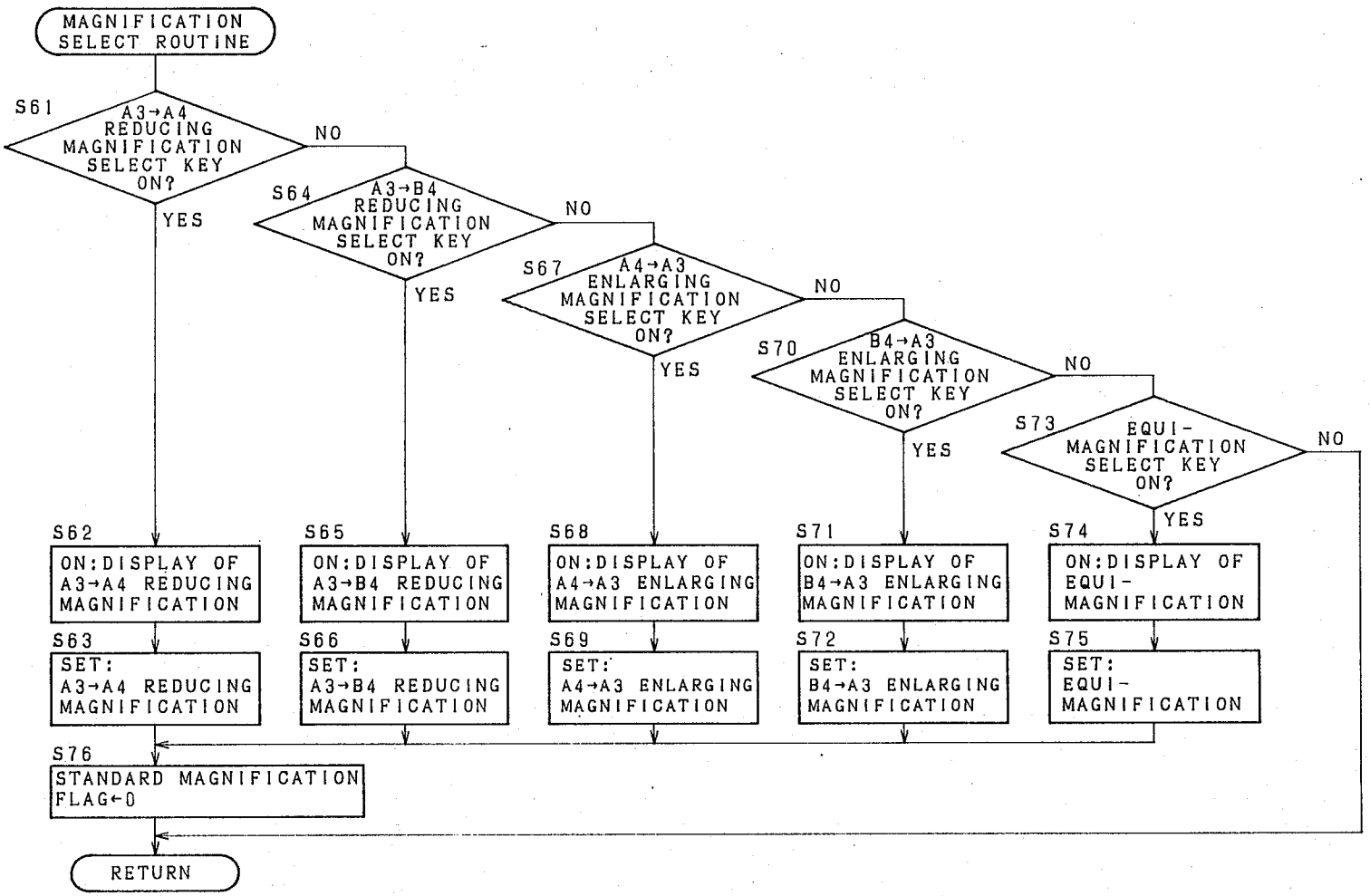

FIG. 7 is a flowchart showing details of the above-mentioned "magnification select routine" in step S2.

By this routine, the magnification for the paper corresponding to the original size is selected manually by operating the A3→A4 reducing magnification select key 80, the A3→B4 reducing magnification select key 82, the A4→A3 enlarging magnification select key 84, the B4→A3 enlarging magnification select key 86 or the equi-magnification select key 88.

On-edge of the A3→A4 reducing magnification select key 80 is judged in step S61, and when on-edge of the A3→A4 reducing magnification select key 80 is just obtained, the corresponding LED indicator 81 is lit in step S62. Subsequently the A3→A4 reducing magnification is set in step 63. Also, on-edge of the A3→B4 reducing magnification select key 82 is judged in step S64, and when the on-edge has been obtained, the corresponding LED indicator 83 is lit in step S65, and that magnification is set in step S66. On-edge of the A4→A3 enlarging magnification select key 84 is judged in the step S67, and when the on-edge has been obtained, the corresponding LED indicator 85 is lit in step S68, and that magnification is set in step S69. On-edge of the B4→A3 enlarging magnification select key 86 is judged in step S70, and when on-edge has been obtained, the corresponding LED indicator 87 is lit in step S71, and that magnification is set in step S72. Also, on-edge of the equi-magnification select key 88 is judged in step S73, and when the on-edge has been obtained, the corresponding LED indicator 89 is lit in step S74, and the equi-magnification is set in step S75, and the standard magnification flag is removed in step S76. On the other hand, when the on-edge of the equi-magnification select key 88 has not been obtained in step S73, processing returns intact without removing the standard magnification flag.

Figure 8:
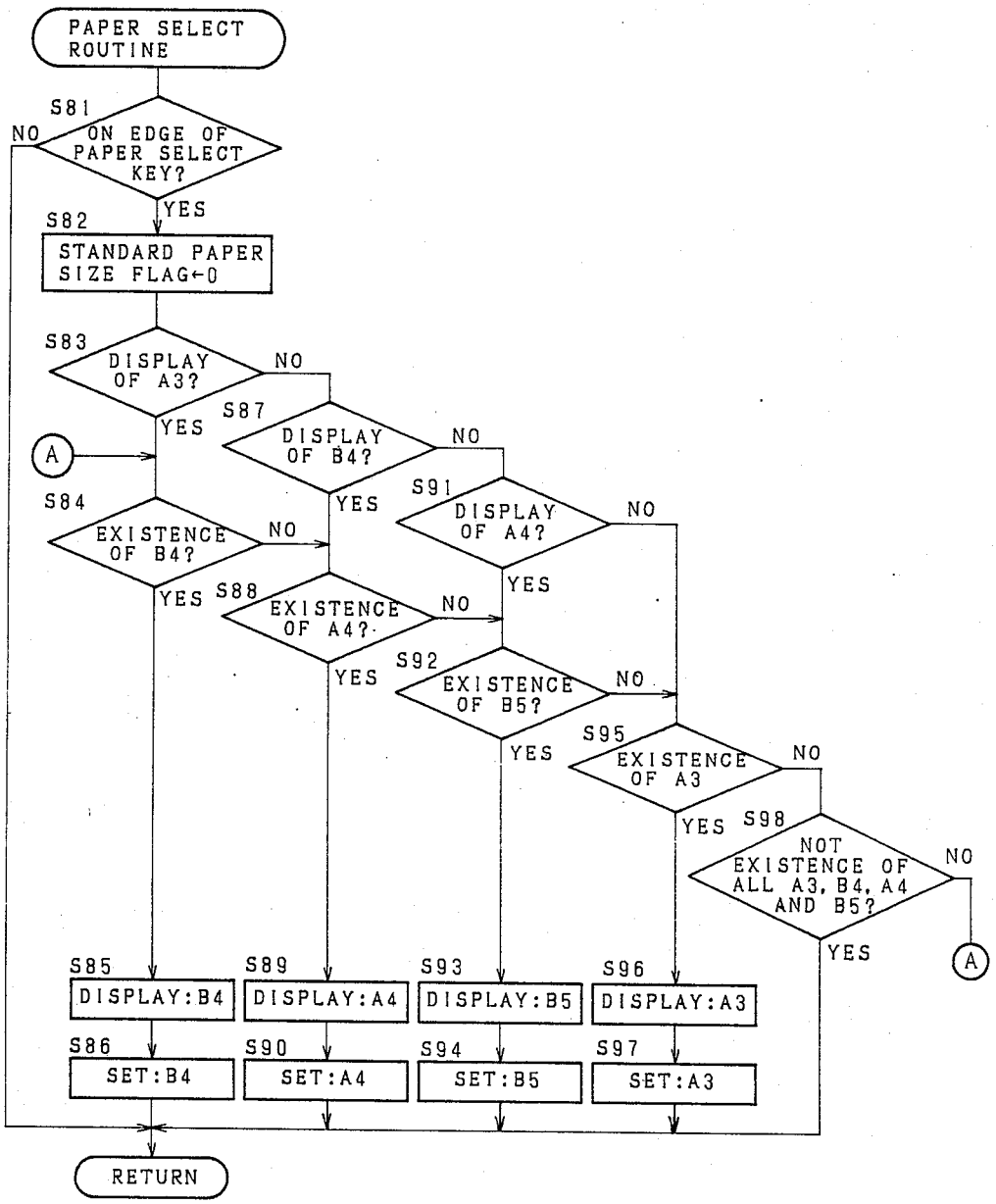

FIG. 8 is a flow chart showing details of the above-mentioned "paper select routine" in step S3.

By this routine, the automatic paper feed cassette of predetermined paper is selected by operating the paper select key 70, and paper selection is made in rotation in a sequence of A3→B4→A4→B5→A3 according to program, but in this embodiment, only two of the automatic paper feed cassettes 21A and 21B are loaded, and therefore paper stored in the automatic paper feed cassette 21A or the automatic paper feed cassette 21B is selected alternatingly.

On-edge of the paper select key 70 is judged in step S81, and when an on-edge signal exists, the standard paper size flag is removed in step S82, and when the on-edge signal is not obtained, processing returns without performing selection. When the on-edge is judged, whether or not the present display is A3 size is judged in step S83 and when the A3 size is displayed, or when it is not judged that all of paper of A3 size, B4 size, A4 size and B5 size do not exist, whether or not the B4 paper is stored is judged in step S84, and when the B4-size paper is stored, B4 is displayed in step S85, and the B4 paper is set in step S86. Also, when the present display is not the A3 size in step S83, judgement is made on whether or not the present display is the B4 size in step S87, and when the B4 size is displayed and when it is judged that the B4 size paper is not stored in step S84, judgment is made on whether or not the A4-size paper is stored in step 88, and when the A4-size paper is stored, A4 is displayed in step S89 and the A4-size paper is set in step S90. Then, when the present display is not the B4 size in step S87, judgment is made on whether or not the present display is the A4 size in step S91, and when the A4 size is displayed and it is judged that the A4-size paper is not stored in step S88, judgment is made on whether or not the B5-size paper is stored in step S92, and when the B5-size paper is stored, B5 is displayed in step S93, and the B5-size paper is set in step S94. Furthermore, when it is judged that the present display is not the A4 size in step S91 and it is judged that the B5-size paper is not stored in step S92, judgment is made on whether or not the A3-size paper is stored in step S95, and when the A3-size paper is stored, A3 is displayed in step S96, and the A3-size paper is set in step S97. Then, when the A3-size paper is not stored in step S95 and it is judged in step S98 that all of paper of A3 size, B4 size, A4 size and B5 size are not stored, processing gets out of this routine and returns.

Thus, processing is programmed so that rotation can be made in sequence of A3→B4→A4→B5→A3 every time the paper select key 71 is turned on or off, and therefore, for example, when the B4-size paper and the B5-size paper are stored, setting is changed-over alternatingly in a sequence of B4→B5→B4→B5.

In addition, this embodiment is constituted in a manner that after completing copying, display of modes not being put in the standard state are performed for warning, and thereafter, when a key is operated before auto-clear the display is returned to the normal display. However, by eliminating the processings in step S76 and step S82, modes not being put in the standard state can be displayed all the duration for warning even if a key is operated after copying is completed.

Figure 9:
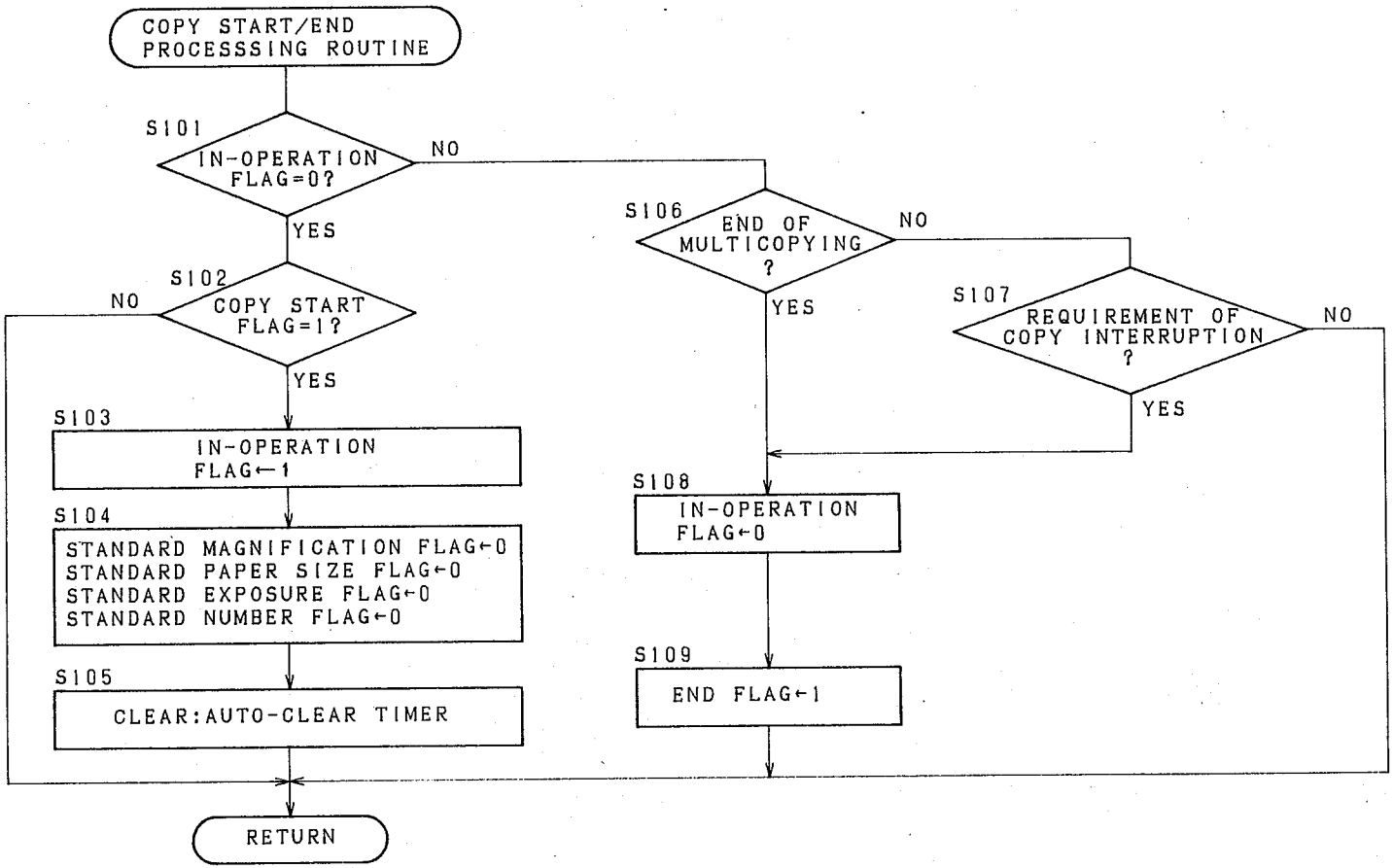

FIG. 9 is the flow chart showing details of the above-mentioned "copy start/end processing routine".

In this routine, judgement is made on whether the copying apparatus has completed copying operation or is in copying operation, and the result is stored in the in-operation flag and in the end flag.

At first, in step S101, judgment is made on whether or not the in-operation flag showing that the copying apparatus is in successive operation is removed. When the in-operation flag is removed, in step S102, the state of the copy start flag set in the "copy operation routine" is checked, and when the copy start flag is set, the in-operation flag is set in step S103, and the standard magnification flag, the standard paper size flag, the standard exposure flag and the standard number flag are removed in step S104. Also, an auto clear timer is cleared in step S105. When the in-operation flag is set by starting copying operation, by judgment of the in-operation flag in step S101 of the following routine, setting of the in-operation flag is judged, and judgment is made on whether or not processing of a predetermined number has ended in step S106. In addition, judgment in step S106 is made at the point when scanning ends in the same way as in step S 21 shown in FIG. 6. This is because this embodiment is configurated so that inputs of various parameters can be performed from the point when the last scanning of multicopying ends.

When processing of a predetermined number has been completed, the in-operation flag is removed in step S108, and an end flag is set in step S109. Also, even when it is judged that processing of the predetermined number has not been completed in step S106, judgment is made on whether or not the interrupt key 56 or the clear step key 57 which breaks operation or interrupts to copy another number during copying operation of the predetermined number in step S107 has been operated, and when the interrupt key 56 or the clear step key 57 has been operated, in the same way as in the case where processing of the predetermined number has been completed, the in-operation flag is removed in step S108, and the end flag is set in step S109. This means that when the interrupt key 56 or the clear stop key 57 has been operated, judgment is made on differences from predetermined standard magnification, standard paper size, standard exposure and standard copy number, and as described later, processing of blinking display is performed only when the modes have a difference from standard.

Figure 10:
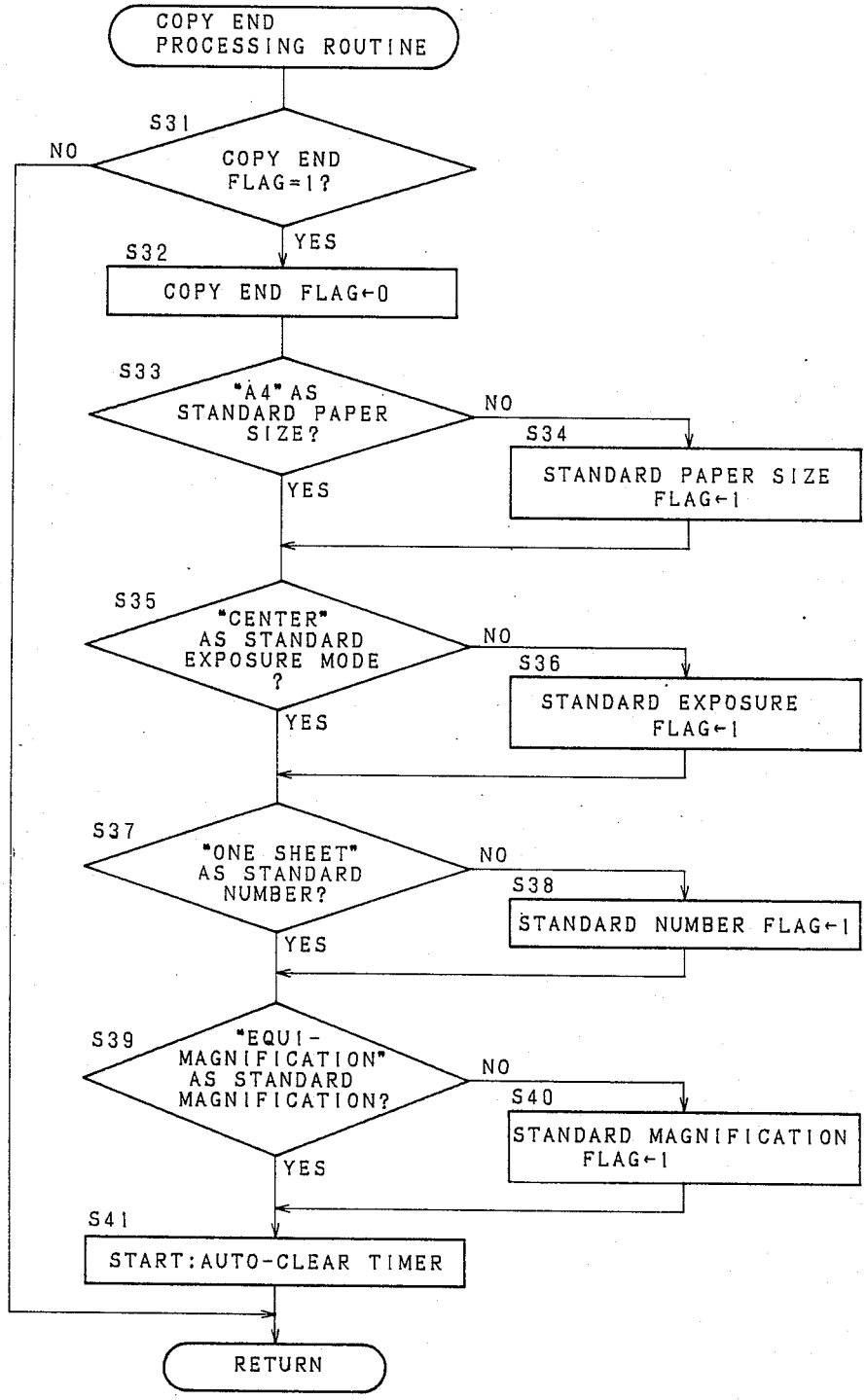

FIG. 10 is a flow chart showing details of the above-mentioned "copy end processing routine" in step M4.

In this routine, when copying operation is completed or when copying operation is broken by operating the clear stop key 57 or the like, judgment is made on differences of the present copying modes from the standard magnification, the standard paper size, the standard exposure and the standard copy number which are set as the initial state, and flags are set only for the modes having a difference, and the differences are stored therein.

First, in step S31, judgment is made on whether or not the end flag has been set, and when the end flag has not been set, processing gets out of this routine. When the end flag has been set, the end flag is removed in step S32, and thereafter in step S33, whether or not the paper size is standard (A4 size in this embodiment) is judged from the present state of outputs of the A3 select display 71, the B4 select display 72, the A4 select display 73 and the B5 select display 74. When the paper size is not standard, the standard paper size flag is set in step S34. Then, in step S35, whether or not the standard exposure level (center in this embodiment) has been set is judged from the present state of outputs of the exposure level displays 46–54 in LED row for image density display. When the standard exposure level has not been set, the standard exposure flag is set in step S36. Furthermore, in step S37, whether or not the standard number (one sheet in this embodiment) has been set is judged from the present state of output of data displayed by the numeral display part 41. When the standard number has not been set, the standard number flag is set in step S38. Then, in step S39, whether or not the standard magnification (equi-magnification in this embodiment) has been set is judged from the present state of outputs of the A3→A4 reducing magnification indicator 81, the A3→B4 reducing magnification indicator 83, the A4→A3 enlarging magnification indicator 85, the B4→A3 enlarging magnification indicator 87, and the equi-magnification indicator 89. When the standard magnification has not been set, the standard magnification flag is set in step S40. After judging these copying modes, in step S41, an auto clear timer for clearing the copying modes of the copying apparatus into the initial state after the lapse of a predetermined duration is started.

Figure 11:
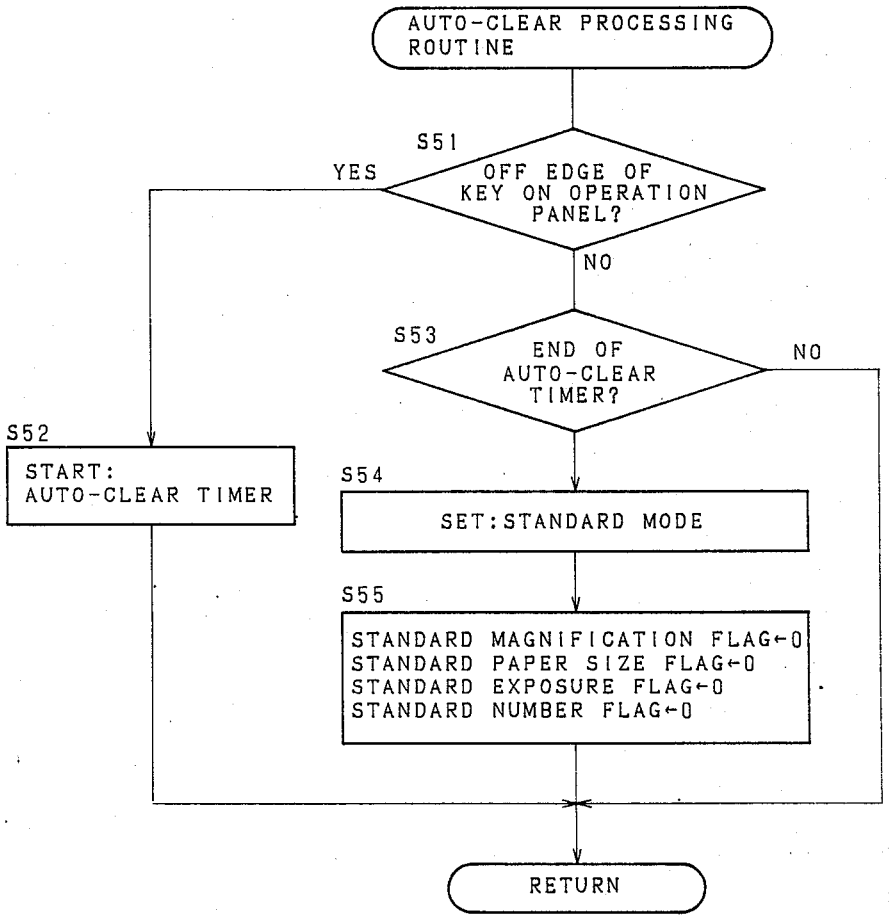

FIG. 11 is a flow chart showing details of the above-mentioned "auto clear processing routine" in step M5.

In this routine, time-up of the auto clear timer is judged to clear the copying modes of the copying apparatus into the initial state after copying has ended or after a predetermined duration from an operation of a key on the operation panel 2. Furthermore, in this routine the process of removing the flags which perform the blinking display mode is different from the mode set as the initial state.

When copying is completed, the auto clear timer is started in step S41 in FIG. 10.

On the other hand, to start the auto clear timer in response to an operation of a key on the operation panel 2, off-edge of a key of the operation part is judged in step S57, and when off-edge is obtained, the auto clear timer is started in step S52. In addition, when performing continuous copying operation, this auto clear timer is cleared in step S105 of the "copy start/end processing routine". Also, when off-edge is not obtained, time-up of the auto clear timer is waited in step S53, and when the auto clear timer expires, in step S54, the copying modes are set to the standard modes set as the initial state, that is, in this embodiment, the standard magnification is set to the equimagnification, the standard paper size to A4, the standard exposure to center, and the standard number to one sheet. In step S55, the standard magnification flag, the standard paper size flag, the standard exposure flag and the standard number flag are removed.

Figure 12:
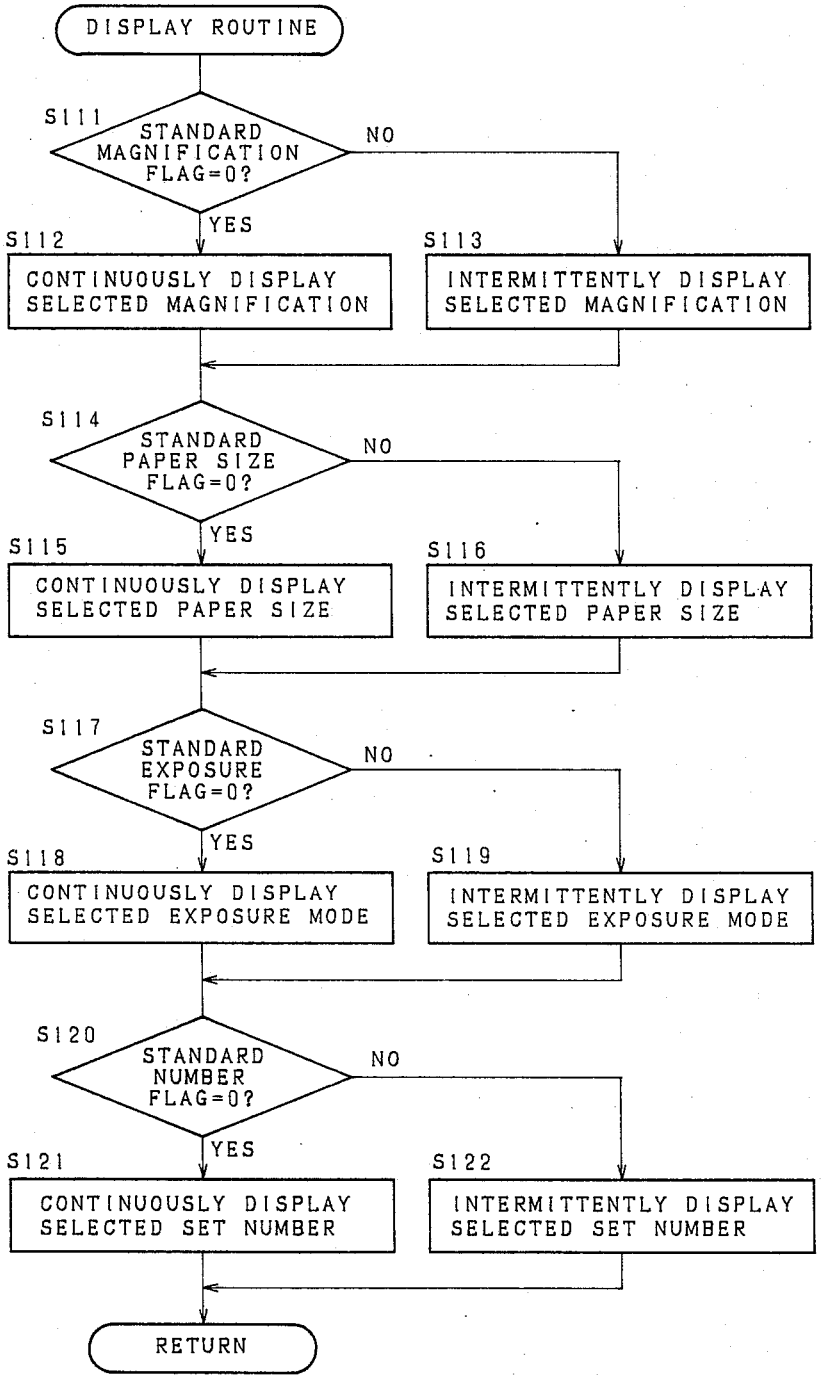

FIG. 12 is a flow chart showing details of the above-mentioned "display routine" in step M6.

In this routine, the standard magnification flag, the standard paper size flag, the standard exposure flag and the standard quantity flag are checked, and blinking displays are performed corresponding to the set flags.

Flag, in step S111, judgment is made on whether or not the standard magnification flag has been removed, then when the standard magnification flag has been removed, the LED indicator displaying the selected magnification is continously lit to display the setting thereof in step S112. On the other hand, when the standard magnification flag has been set, the indicator of the selector of the selected magnification is displayed in a blinking fashion (flick display) in step S113.

Then, in step S114, judgment is made on whether or not the standard paper size flag has been removed, and when the standard paper size flag has been removed, the LED indicator displaying the selected paper size is continuously lit to display the setting thereof in step S115. On the other hand, when the standard paper size flag has been set, the indicator corresponding to the selected paper size is displayed in a blinking fashion in step S116.

In step S117, judgment is made on whether or not the standard exposure flag has been removed, and when the standard exposure flag has been removed, the LED indicator corresponding to the selected density of the exposure level displays 46-54 in the LED row for image density display is continuously lit to display the setting thereof in step S118. On the other hand, when the standard exposure flag has been set, the indicator corresponding to the selected exposure level is displayed in a blinking fashion in step S119.

In step S120, judgment is made on whether or not the standard number flag has been removed, and when the standard number flag has been removed, the number display of numeral display part 41 is continuously lit to display the setting thereof in step S121. On the other hand, when the standard number flag has been set, the set value is displayed in a blinking fashion in step S122.

Accordingly, in the case where the state of each parameter set by selective operation of each key on the operation panel 2 differs from the standard state, until the copying modes are auto-cleared and each parameter is put in the standard state, the indicators corresponding to the parameters different from the standard state are displayed in a blinking fashion by the first microcomputer CPU 1 as a controlling means, and in the case where the state of the parameter agrees with the standard state, continuous lighting is performed.

Since such control is performed, even in the case where another user performs copying anew during the time from the end of a series of copying to auto-clearing thereafter, the state can be easily recognized because of blinking of the indicators corresponding to the keys set to the state different from the state of standard setting, and thereby the possibility of wrong copying is reduced.

Also, in the above-mentioned embodiment, the end of copying is judged at the point of the end of scanning, but needless to say, a configuration of judgment by the discharge of the copied paper to the tray, stop of the main motor or the like can also be adopted.

Furthermore, in the above-described embodiment, normally the indicators are continuously lit, and the indicators are lit in a blinking fashion when the selected copying mode differs from the standard state, but needless to say, another display form can also be applied. For an example, in the copying apparatus provided with a character display, setting different from the standard state can be displayed by a direct message.

Also, the present invention is applicable to a copying apparatus having the simplex/duplex mode, the composite mode, and further various optional modes for sorter in addition to the modes described in the above-mentioned embodiment.

Furthermore, in the above-mentioned embodiment, the time for control is from the point of the end of copying operation to the point of auto-clear, but in a copying apparatus having no auto-clear function, the time for control can be from the end of copying operation to any key-operation by the user or to the point of return of all the modes to the standard state.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A copying apparatus comprising:

copying means for copying an original image on a copy paper;

parameter setting means for setting conditions on a copying operation to be performed by said copying means;

displaying means for displaying setting states corresponding to the conditions set by said parameter setting means;

copy end detecting means for detecting the end of the copying operation performed by said copying means;

storing means for storing standard setting states corresponding to the conditions on a standard copying operation; and controlling means for making said displaying means display the setting states corresponding to the conditions set by said parameter setting means in a first display form, and for making said displaying means display the setting states different from the standard states stored in said storing means in a second display form different from said first display form when the end of copying operation has been detected by said copy end detecting means.

2. A copying apparatus as set forth in claim 1, wherein said displaying means are a plurality of indicators corresponding respectively to a plurality of states of each condition set in said parameter setting means.

3. A copying apparatus as set forth in claim 2, wherein said first display form is continuous lighting of said indicators and said second display form is intermittent lighting of said indicators.

4. A copying apparatus as set forth in claim 1, wherein said displaying means are numeral displays displaying numeric values respectively corresponding to a plurality of states of each condition set in said parameter setting means.

5. A copying apparatus as set forth in claim 4, wherein said first display form is continuous lighting of said numeral displays and said second display form is intermittent display of said numeral displays.

6. A copying apparatus as set forth in claim 1, comprising a means for automatically returning the setting state of said parameter setting means to the state stored in said storing means after a predetermined duration has elapsed from the point of detection of the end of copying operation by said copy end detecting means.

7. A copying apparatus as set forth in claim 6, wherein said displaying means are a plurality of indicators corresponding respectively to a plurality of states of each condition set in said parameter setting means.

8. A copying apparatus as set forth in claim 7, wherein said first display form is continuous lighting of said indicators and said second display form is intermittent lighting of said indicators.

9. A copying apparatus as set forth in claim 6, wherein said displaying means are numeral displays displaying numeric values corresponding respectively to a plurality of states of each condition set in said parameter setting means.

10. A copying apparatus as set forth in claim 9, wherein said first display form is continous lighting of said numeral displays, and said second display form is intermittent lighting of said numeral displays.

11. A copying apparatus comprising:

copying means for copying an original image on a copy paper;

parameter setting means for setting conditions on a copying operation to be performed by said copying means;

a plurality of display members for displaying conditions set by said parameter setting means, wherein each of the display members corresponds to each of the conditions;

copy end detecting means for detecting the end of copying operation performed by said copying means;

storing means for storing standard conditions to be used for a standard copying operation; and controlling means for making said plurality of display members display the conditions set by said parameter setting means in a first display form, and when the end of copying operation has been detected by said copy end detecting means in a situation where at least one of the conditions set by said parameter setting means differs from the corresponding condition stored in said storing means, for making said corresponding display member display in a second display form different from said first display form.

12. A copying apparatus comprising:

copying means for copying an original image on a copy paper;

parameter setting means for setting conditions on a copying operation to be performed by said copying means;

displaying means for displaying the conditions of said parameter setting means;

copy end detecting means for detecting the end of copying operation performed by said copying means;

storing means for storing standard conditions to be used for a standard copying operation;

first controlling means for making said displaying means display in a first display form, and when the end of copying operation has been detected by said copy end detecting means, where the condition of said parameter setting means differs from the condition stored in said storing means, for making said displaying means display in a second display form different from said first display form; and second controlling means for controlling said displaying means so that the condition displayed in said second display form is displayed in said first display form when said parameter setting means is operated.

* * * * *